US006843585B1

(12) United States Patent
Martin et al.

(10) Patent No.: US 6,843,585 B1
(45) Date of Patent: Jan. 18, 2005

(54) MOUNTING ASSEMBLY FOR HIGH OUTPUT ELECTRODELESS LAMP

(75) Inventors: Robert Martin, Drummondville (CA); Jean F. Rouleau, Drummondville (CA); Daniel Marian, Roscoe, NY (US)

(73) Assignee: Osram Sylvania Inc., Danvers, MA (US)

( * ) Notice: Subject to any disclaimer, the term of this patent is extended or adjusted under 35 U.S.C. 154(b) by 37 days.

(21) Appl. No.: 10/603,360

(22) Filed: Jun. 25, 2003

(51) Int. Cl.[7] ..... F21V 29/00; F21V 7/20

(52) U.S. Cl. ..... 362/294; 362/218; 362/264; 362/345

(58) Field of Search ..... 362/294, 580, 362/547, 126, 218, 264, 345, 373

(56) References Cited

U.S. PATENT DOCUMENTS 6,175,197 B1 1/2001 Kling ..... 315/248

*Primary Examiner*—Thomas M. Sember
*Assistant Examiner*—Bao Q. Truong
(74) *Attorney, Agent, or Firm*—Carlo S. Bessone

(57) ABSTRACT

A mounting assembly (10) for an electrodeless 1 amp (100). The mounting assembly (10) comprises a fixture housing (14) having an inner surface (16) and an outer surface (18). The fixture housing is preferably made from aluminum. Spaced-apart heat sinks (20, 21) are affixed to the inner surface (16) of the fixture housing (14). A reflector (22), which is preferably concave, as is the fixture housing, is positioned within the fixture housing (14). The reflector (22) contains two apertures (24, 26) that are aligned with the heat sinks (20, 21). Thermal insulators (28, 29) are positioned in the apertures and surround the heat sinks, thus thermally isolating the reflector from the heat sinks. The lamp (100) is mounted in the fixture housing by attaching brackets (40, 42), which surround the ferrite transformer cores of the lamp, directly to the top surfaces of the heat sinks (20, 21). Mounting is preferably accomplished by having threaded holes formed in the heat sinks and fixing the brackets in place via screws through the legs (44) and screw receiving slots (46).

7 Claims, 2 Drawing Sheets

MOUNTING ASSEMBLY FOR HIGH OUTPUT ELECTRODELESS LAMP

TECHNICAL FIELD

This invention relates to lamps and more particularly to high output electrodeless lamps (hereinafter, HOEL). Still more particularly it relates to a mounting assembly for such lamps.

BACKGROUND ART

HOELs are known lamps and are disclosed in, for example, U.S. Pat. No. 6,175,197, which is assigned to the assignee of the instant invention and whose teachings are hereby incorporated by reference. These lamps have specific allowable operating temperatures, which must be met in fixture applications. In many fixtures where the fixture housing and the reflector are separate components, the reflector dish can get too hot too quickly due to radiation from the lamp and to heat transferred from the ferrite cores (necessary for lamp operation) to the reflector through the mounting brackets for the lamp. Because of the high temperature of the reflector, ferrite core heat sinking (which is crucial for proper operation) is reduced, and the lamp glass and the amalgam tip operate hotter due to re-radiation from the reflector. These undesired conditions adversely effect the operation of the lamp.

Accordingly, it would be an advance in the art to provide a mounting assembly for such lamps that would adequately dissipate heat generated by operation of the lamp, thus improving efficacy and life.

DISCLOSURE OF INVENTION

It is, therefore, an object of the invention to obviate the disadvantages of the prior art.

It is another object of the invention to enhance the operation of HOELs.

It is yet another object of the invention to provide heat dissipation in fixtures for HOELs.

These objects are accomplished, in one aspect of the invention, by a mounting assembly for a high output electrodeless lamp comprising; a fixture housing having an inner surface and an outer surface; a pair of spaced-apart heat sinks affixed to the inner surface of the fixture housing and extending therefrom: a reflector positioned within the fixture housing, the reflector containing two apertures aligned with the heat sinks; a thermal insulator surrounding each of the heat sinks in the apertures and thermally isolating the reflector from the heat sinks; and an electrodeless lamp mounted to the heat sinks.

This assembly effectively isolates the lamp from the reflector and dissipates the heat generated by operation of the lamp directly to the fixture housing.

BEST MODE FOR CARRYING OUT THE INVENTION

For a better understanding of the present invention, together with other and further objects, advantages and capabilities thereof, reference is made to the following disclosure and appended claims in conjunction with the above-described drawings.

Figure 1:
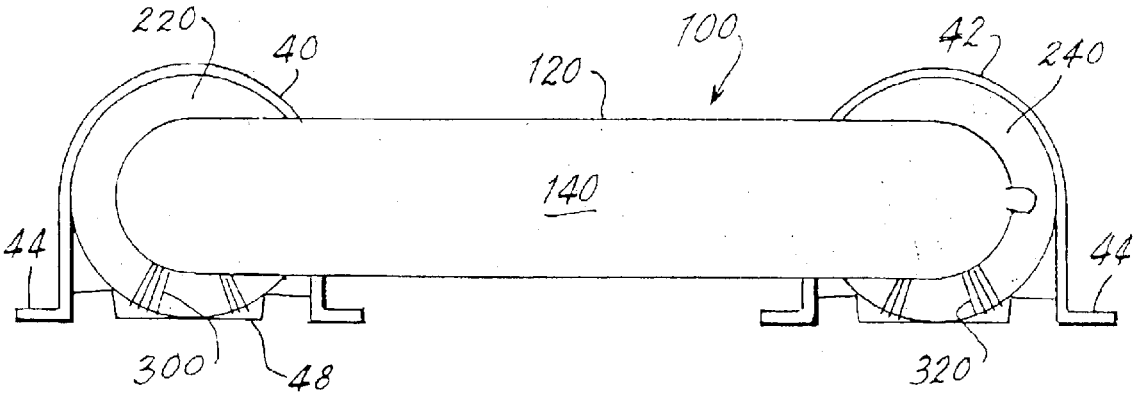
FIG. 1 is a side view of a lamp employable with the invention.
Figure 2:
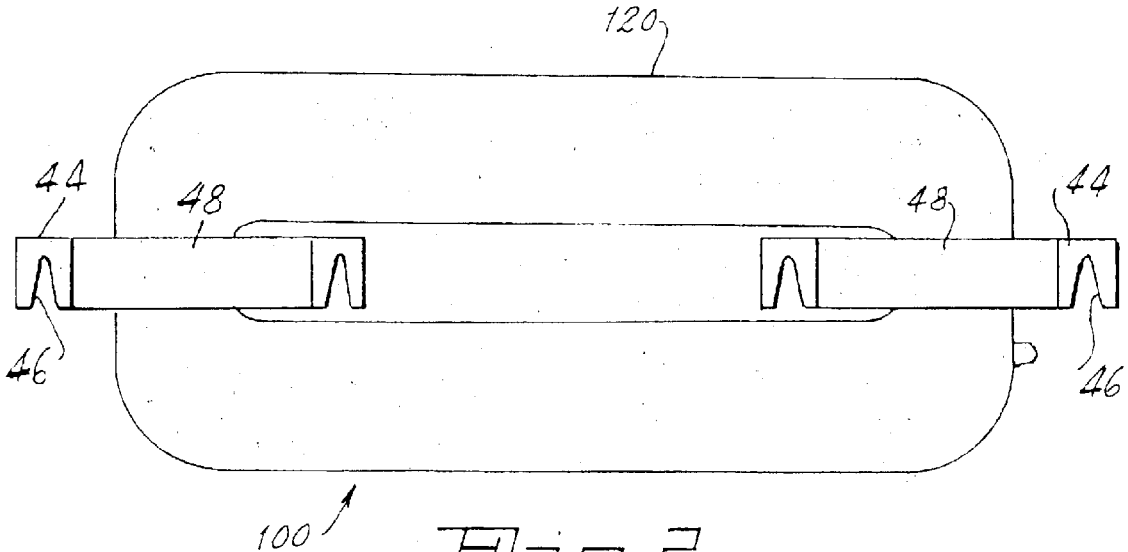
FIG. 2 is an elevational view of the lamp of FIG. 1.

Referring now to FIGS. 1 and 2 there is shown a lamp 100 which has lamp envelope 120 which has a tubular, closed-loop configuration and is electrodeless. The lamp 100 encloses a discharge region 140 containing a buffer gas and mercury vapor. A phosphor coating may be formed on the inside surface of lamp envelope 120. Radio frequency (RF) energy from an RF source (not shown, but see the aforementioned U.S. Pat. No. 6,175,197) is inductively coupled to lamp 100 by a first ferrite transformer core 220 and a second ferrite transformer core 240. Each of the transformer cores preferably has a toroidal configuration that surrounds the lamp envelope 120. The RF source is connected to a winding 300 on the first transformer core 220 and is connected to a winding 320 on the second transformer core 240.

Mounting brackets 40 and 42 encompass the transformer cores and have legs 44 provided with appropriate mounting means, such as screw receiving slots 46. Retention springs 48 may also be provided to maintain the brackets in position prior to final assembly of the lamp to a fixture.

Figure 3:
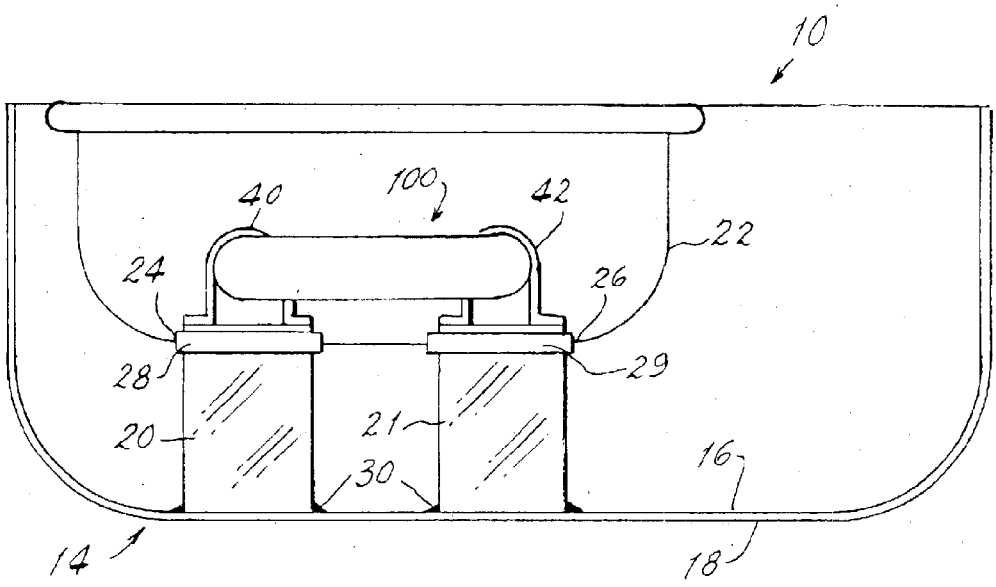
FIG. 3 is a diagrammatic side sectional view of a mounting assembly in accordance with an aspect of the invention.
Figure 4:
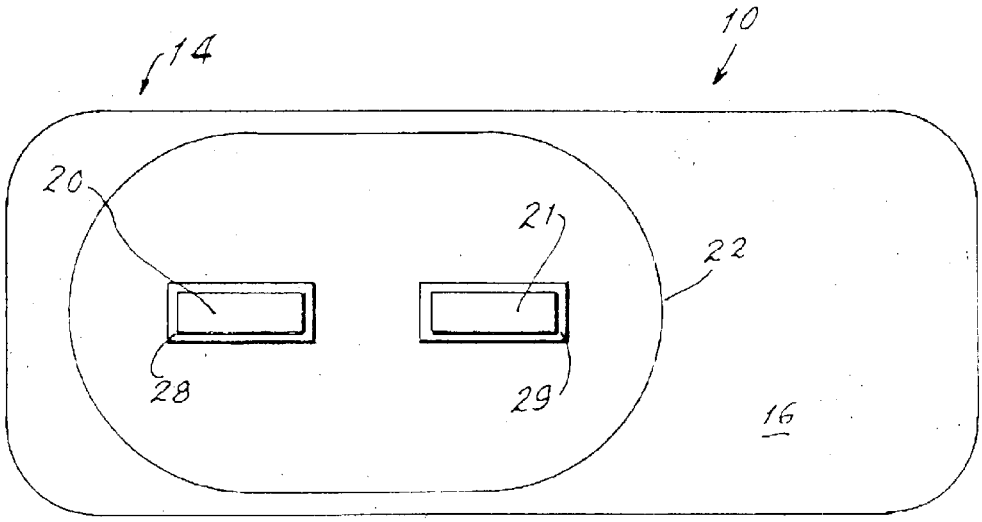
FIG. 4 is a elevational view of the mounting assembly of FIG. 3 with the 1 amp removed.

Referring now to FIGS. 3 and 4, there is shown a mounting assembly 10 for a lamp 100, which mounting assembly comprises a fixture housing 14 having an inner surface 16 and an outer surface 18. The fixture housing is preferably made from aluminum.

Spaced-apart heat sinks 20, 21 are affixed to the inner surface 16 of the fixture housing 14 and in a preferred embodiment are integral with the housing. In an alternate embodiment the heat sinks can be welded, as at 30, to the inner surface. Also, in yet another alternate embodiment, the heat sinks and the fixture housing can be different materials, as may be dictated by the end use of the assembly.

A reflector 22, which is preferably concave, as is the fixture housing, is positioned within the fixture housing 14. The reflector 22 contains two apertures 24, 26 that are aligned with the heat sinks 20, 21. Thermal insulators 28, 29 are positioned in the apertures and surround the heat sinks, thus thermally isolating the reflector from the heat sinks.

The lamp 100 is mounted in the fixture housing by attaching the brackets 40, 42 directly to the top surfaces of the heat sinks 20, 21. Mounting is preferably accomplished by having threaded holes formed in the heat sinks and fixing the brackets in place via screws through the legs 44 and screw receiving slots 46.

This construction insures that the reflector will not be heated by the ferrite transformer cores and thus will be cooler during lamp operation. Therefore, the lamp glass bulb and amalgam tip temperature will be cooler, enhancing the operation of the lamp, increasing efficacy and life.

While there have been shown and described what are at present considered to be the preferred embodiments of the invention, it will be apparent to those skilled in the art that various changes and modification can be made herein without departing from the scope of the invention as defined by the appended claims.

What is claimed is:

1. A mounting assembly for a high output electrodeless lamp comprising;

a fixture housing having an inner surface and an outer surface;

a pair of spaced-apart heat sinks affixed to said inner surface of said fixture housing and extending therefrom:

a reflector positioned within said fixture housing, said reflector containing two apertures aligned with said heat sinks;

a thermal insulator surrounding each of said heat sinks in said apertures and thermally isolating said reflector from said heat sinks; and an electrodeless lamp mounted to said heat sinks.

2. The mounting assembly of claim 1 wherein said heat sinks are formed integrally with said fixture housing.

3. The mounting assembly of claim 1 wherein said heat sinks are formed distinct from said fixture housing and are welded thereto.

4. The mounting assembly of claim 3 wherein said heat sinks are a different material than said fixture housing.

5. The mounting assembly of claim 1 wherein said fixture housing is concave.

6. The mounting assembly of claim 5 wherein said reflector is concave.

7. The mounting assembly of claim 1 wherein said thermal insulator is formed from a material selected from ceramic, silicon or rubber.

* * * * *